US005897018A

United States Patent [19]

Pruitt

[11] Patent Number: 5,897,018

[45] Date of Patent: Apr. 27, 1999

[54] GARBAGE CAN WITH WEIGHTED BASE

[76] Inventor: Larry Pruitt, 184 Cooper Way, Vallejo, Calif. 94589

[21] Appl. No.: 09/044,321

[22] Filed: Mar. 19, 1998

[51] Int. Cl.[6] ..... A47G 23/02

[52] U.S. Cl. ..... 220/603; 220/908; 248/146

[58] Field of Search ..... 220/603, 908; 248/146

[56] References Cited

U.S. PATENT DOCUMENTS

| | | | |
|---|---|---|---|
| 62,949 | 3/1867 | Farley | 220/603 |
| 1,645,525 | 10/1927 | Fleming | 220/603 |
| 4,872,582 | 10/1989 | Sipple | 220/603 |
| 4,905,945 | 3/1990 | Peterson | 220/603 |
| 5,088,948 | 2/1992 | Scheurer | 220/603 |
| 5,477,881 | 12/1995 | Fujinaka et al. | 220/603 |
| 5,489,043 | 2/1996 | Newman | 220/603 |

*Primary Examiner*—Joseph M. Moy

[57] ABSTRACT

A garbage can is provided including a weighted base having a recess formed therein. Also included is a garbage can having a bottom adapted to be releasably situated within the recess of the base. Next provided is a plurality of locking tabs for coupling the can within the base.

7 Claims, 4 Drawing Sheets

16
12
18

19

22

GARBAGE CAN WITH WEIGHTED BASE

BACKGROUND OF THE INVENTION

1. Field of the Invention

The present invention relates to garbage can locking systems and more particularly pertains to a new garbage can with weighted base for preventing the loss of a garbage can.

2. Description of the Prior Art

The use of garbage can locking systems is known in the prior art. More specifically, garbage can locking systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art garbage can locking systems include U.S. Pat. No. 5,118,144; U.S. Pat. No. 4,872,582; U.S. Pat. No. 4,072,286; U.S. Pat. No. 5,105,972; U.S. Pat. No. 4,932,621; and U.S. Pat. Des. 331,792.

In these respects, the garbage can with weighted base according to the present invention substantially departs from the conventional concepts and designs of the prior art, and in so doing provides an apparatus primarily developed for the purpose of preventing the loss of a garbage can.

SUMMARY OF THE INVENTION

In view of the foregoing disadvantages inherent in the known types of garbage can locking systems now present in the prior art, the present invention provides a new garbage can with weighted base construction wherein the same can be utilized for preventing the loss of a garbage can.

The general purpose of the present invention, which will be described subsequently in greater detail, is to provide a new garbage can with weighted base apparatus and method which has many of the advantages of the garbage can locking systems mentioned heretofore and many novel features that result in a new garbage can with weighted base which is not anticipated, rendered obvious, suggested, or even implied by any of the prior art garbage can locking systems, either alone or in any combination thereof.

To attain this, the present invention generally comprises a base having a hollow rectangular configuration. The base is equipped with a top face, a bottom face and a thin periphery formed therebetween for defining an interior space. The top face has a cylindrical recess formed in a central extent thereof. The top face further has an inlet aperture formed therein with a threaded neck. The threaded neck is adapted for releasably coupling with a cap thereby allowing the selective filling of the interior space of the base with water. The top face further has a plurality of rectangular locking tabs. Such tabs each have a bottom edge hingably coupled about a periphery of the recess. An interior surface of each tab is equipped with a lateral groove formed therein. As shown in FIG. 4, the bottom face of the base has a matrix of vertically oriented pegs formed thereon and depending downwardly therefrom for inserting within earth. A first one of four side faces of the thin periphery of the base has a horizontally oriented closed loop handle mounted thereon. A second one of the four side faces opposite the first includes ends each with a pair of vertically spaced disk-shaped bumpers extending therefrom. A vertically oriented thin window is mounted on a third one of the side faces for affording a view of a present level of water within the base. Finally, a fourth one of the side faces has an outlet aperture formed therein. Similar to the inlet aperture, the outlet aperture is equipped with a threaded neck coupled about the outlet aperture and extended outwardly therefrom. The threaded neck of the outlet aperture is adapted for releasably coupling with a cap. This structure allows the selective emptying of the water within the interior space of the base. FIG. 5 includes a garbage can having a closed circular bottom face and an inverted frusto-conical side wall extending upwardly to terminate at an upper peripheral edge. A pair of closed loop handles are integrally formed on diametrically opposed sides of the side wall. A lid is provided defining a portion of a hollow sphere. A pair of handle defining grooves are formed in its apex. An annular flange depends from the lid for engaging with an interior surface of the upper peripheral edge of the side wall. An annular protrusion is formed on the side wall of the garbage can and extends radially therefrom. Such annular protrusion resides adjacent to the bottom face of the garbage can for coupling with the grooves of the locking tabs of the base. FIGS. 5 & 6 show a wheel assembly including a pair of a legs having inboard ends pivotally coupled to the side wall of the garbage can about a common axis. A pair of wheels are each rotatably coupled to an outboard end of an associated one of the legs. A pair of notches are formed in the side wall of the garbage can between the legs and both above and below the axis. An arcuate connector bar is integrally coupled between a central extent of the legs and further releasably coupleable with the notches. As such, the wheels may be pivoted coincidentally between a lowered deployed orientation and a raised stored orientation. Finally, a flexible draining hose includes a first end with a rotatable threaded sleeve. Such sleeve serves for screwably coupling with the neck of the outlet aperture.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new garbage can with weighted base apparatus and method which has many of the advantages of the garbage can locking systems mentioned heretofore and many novel features that result in a new garbage can with weighted base which is not anticipated, rendered obvious, suggested, or even implied by any of the prior art garbage can locking systems, either alone or in any combination thereof.

It is another object of the present invention to provide a new garbage can with weighted base which may be easily and efficiently manufactured and marketed.

It is a further object of the present invention to provide a new garbage can with weighted base which is of a durable and reliable construction.

An even further object of the present invention is to provide a new garbage can with weighted base which is susceptible of a low cost of manufacture with regard to both materials and labor, and which accordingly is then susceptible of low prices of sale to the consuming public, thereby making such garbage can with weighted base economically available to the buying public.

Still yet another object of the present invention is to provide a new garbage can with weighted base which provides in the apparatuses and methods of the prior art some of the advantages thereof, while simultaneously overcoming some of the disadvantages normally associated therewith.

Still another object of the present invention is to provide a new garbage can with weighted base for preventing the loss of a garbage can.

Even still another object of the present invention is to provide a new garbage can that includes a weighted base having a recess formed therein. Also included is a garbage can having a bottom adapted to be releasably situated within the recess of the base. Next provided is a plurality of locking tabs for coupling the can within the base.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
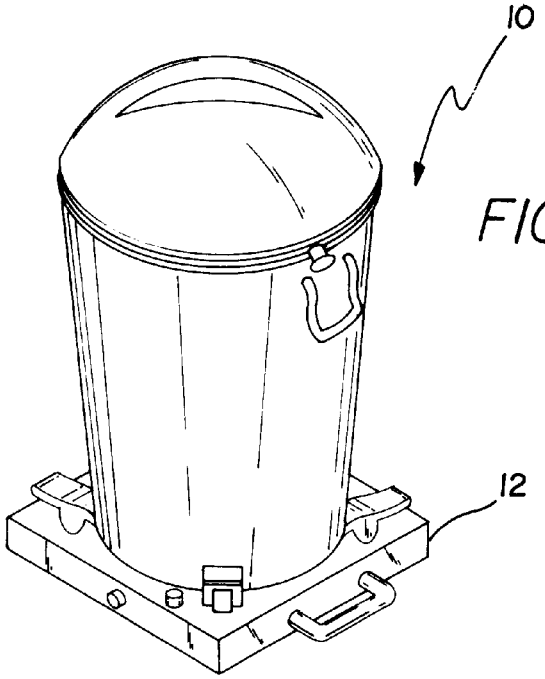
FIG. 1 is a perspective view of an embodiment of the present invention.
Figure 2:
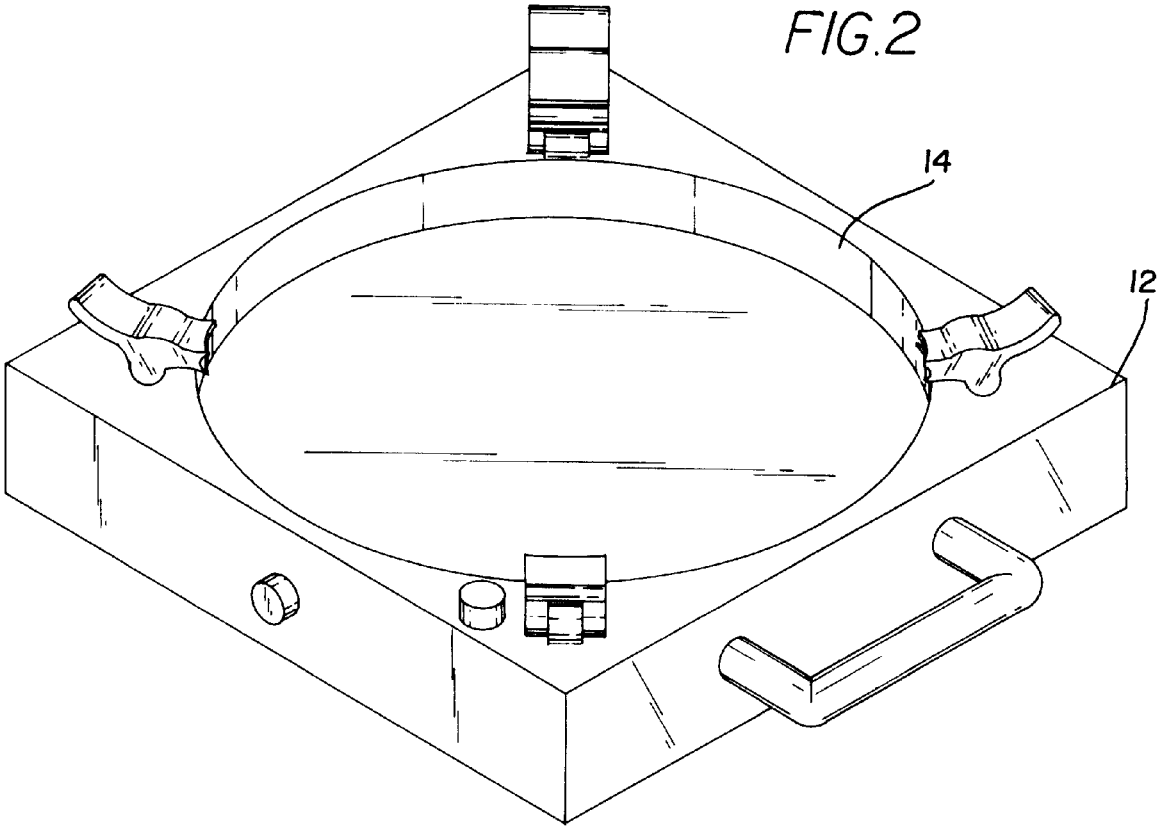
FIG. 2 is a perspective view of the base of the embodiment of the present invention shown in FIG. 1.
Figure 3:
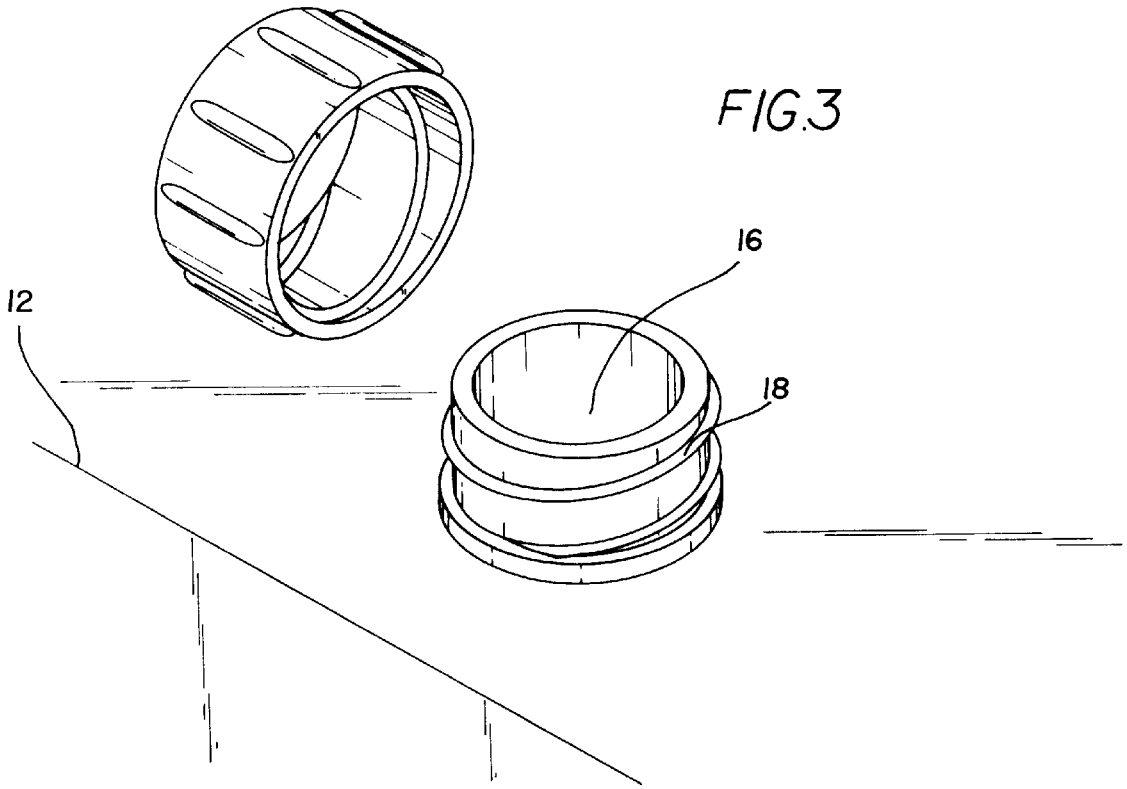
FIG. 3 is a perspective view of the inlet aperture of the present invention.

With reference now to the drawings, and in particular to FIGS. 1 through 8 thereof, a new garbage can with weighted base embodying the principles and concepts of the present invention and generally designated by the reference numeral 10 will be described.

Figure 4:
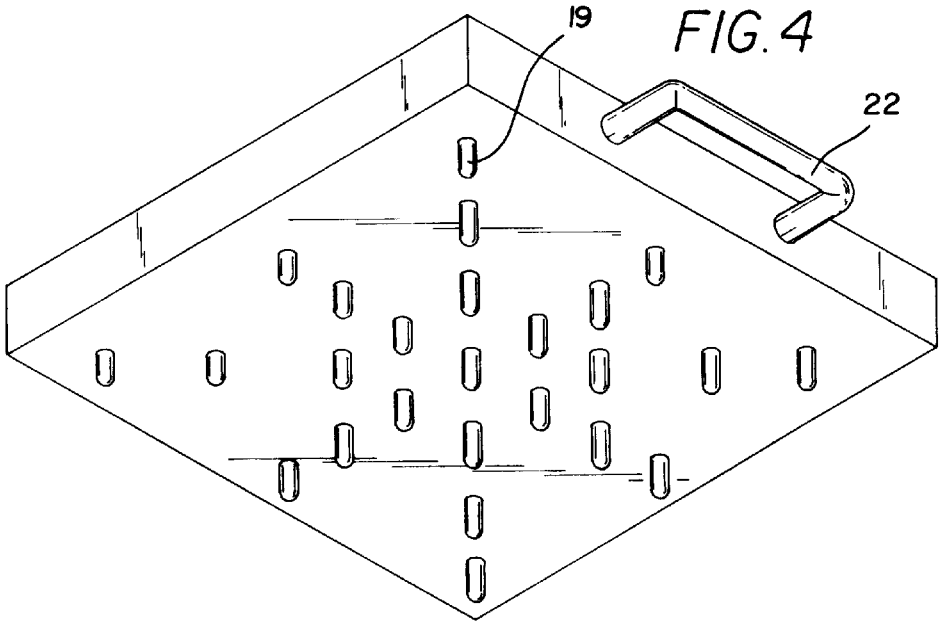
FIG. 4 is a bottom perspective view of the present invention.

The present invention, designated as numeral 10, includes a base 12 having a hollow rectangular configuration. The base is equipped with a top face, a bottom face and a thin periphery formed therebetween for defining an interior space. The top face has a cylindrical recess 14 formed in a central extent thereof. The top face further has an inlet aperture 16 formed therein with a threaded neck 18. The threaded neck is adapted for releasably coupling with a cap thereby allowing the selective filling of the interior space of the base with water. As shown in FIG. 4, the bottom face of the base has a matrix of vertically oriented pegs 19 formed thereon and depending downwardly therefrom for inserting within earth. It should be noted that the pegs not only stabilize the base, but also allows grass to breath thereunder.

The top face further has a plurality of rectangular locking tabs 20. Such tabs each have a bottom edge hingably coupled about a periphery of the recess. An interior surface of each tab is equipped with a lateral groove formed therein for reasons that will soon become apparent. It should be noted that in an alternative embodiment, the tabs may be pivotally coupled to the base at a central extent thereof, thus defining associated handles. Note FIGS. 1 & 2.

A first one of four side faces of the thin periphery of the base has a horizontally oriented closed loop handle 22 mounted thereon. A second one of the four side faces opposite the first includes ends each with a pair of vertically spaced disk-shaped bumpers 24 extending therefrom. A vertically oriented thin window 26 is mounted on a third one of the side faces for affording a view of a present level of water within the base. Finally, a fourth one of the side faces has an outlet aperture 28 formed therein. Similar to the inlet aperture, the outlet aperture is equipped with a threaded neck coupled about the outlet aperture and extended outwardly therefrom. The threaded neck of the outlet aperture is adapted for releasably coupling with a cap. This structure allows the selective emptying of the water within the interior space of the base. In the preferred embodiment, a breathing aperture 30 is formed in the side face associated with the window. Such breathing aperture has a plug screwably coupled therein for selectively allowing the release of water from base. Note FIG. 8.

Figure 5:
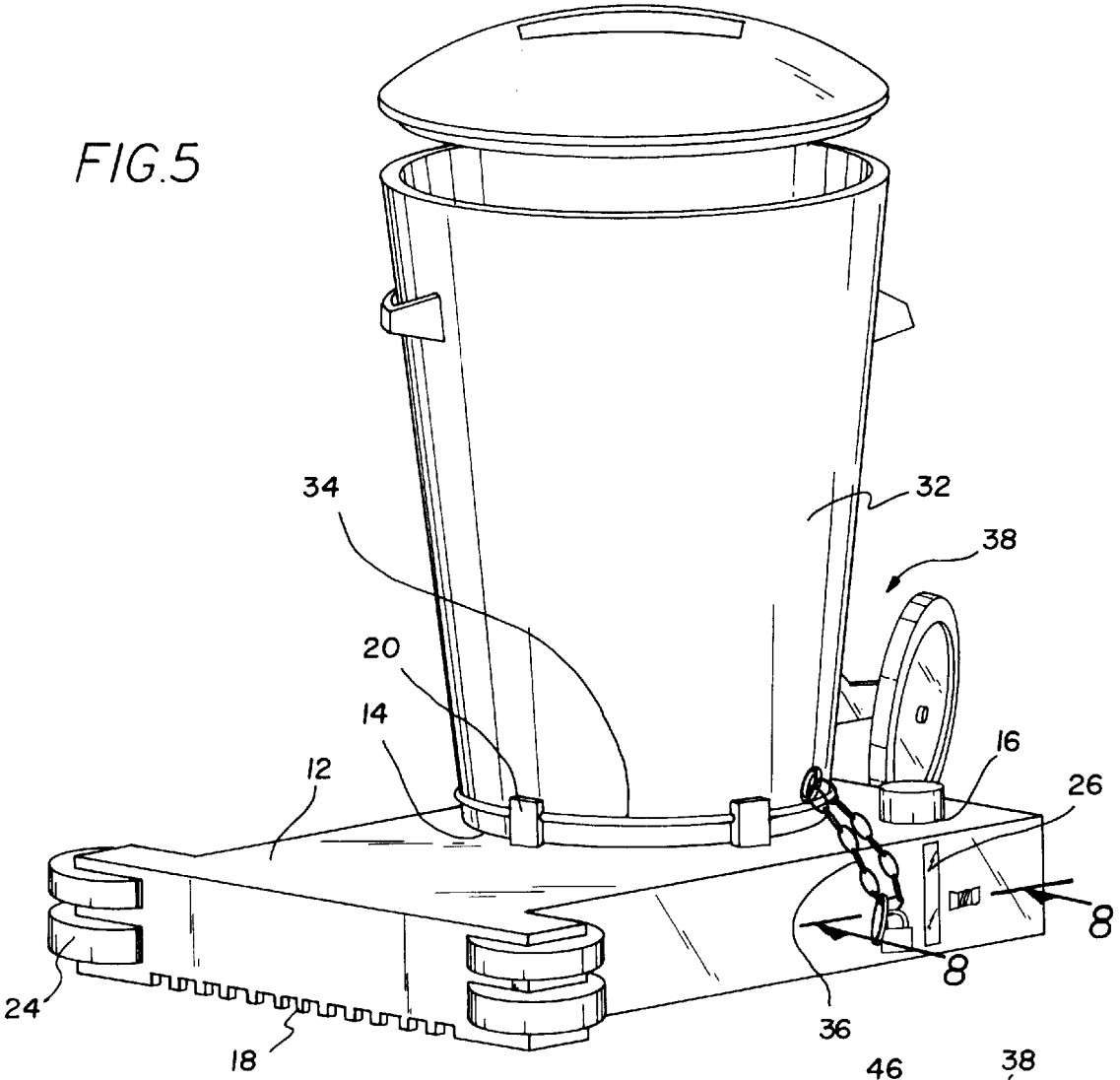
FIG. 5 is a perspective view of another embodiment of the present invention.

FIG. 5 includes a garbage can 32 having a closed circular bottom face and an inverted frusto-conical side wall extending upwardly therefrom to terminate at an upper peripheral edge. For facilitating the removal of a bag from the can, a plurality of unillustrated oval recesses are preferably formed in an interior surface of the can. A pair of closed loop handles are integrally formed on diametrically opposed sides of the side wall of the garbage can.

A lid is provided defining a portion of a hollow sphere. A pair of handle defining grooves are formed in an apex of the lid. An annular flange depends from the lid for engaging with an interior surface of the upper peripheral edge of the side wall. Working in conjunction with the annular flange of the lid is an optional pair of locking pins for further securing the lid to the can. Note FIG. 1.

An annular protrusion 34 is formed on the side wall of the garbage can and extends radially therefrom. Such annular protrusion resides adjacent to the bottom face of the garbage can for coupling with the grooves of the locking tabs of the base. To prevent the theft of the can, a loop is formed therein and the base for allowing the passage of a chain 36 and lock.

Figure 6:
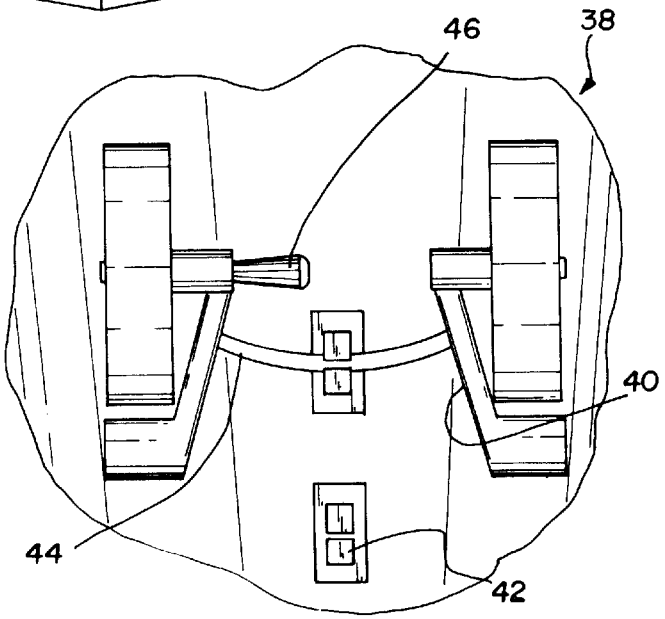
FIG. 6 is a side view of the wheel assembly of the present invention.
Figure 7:
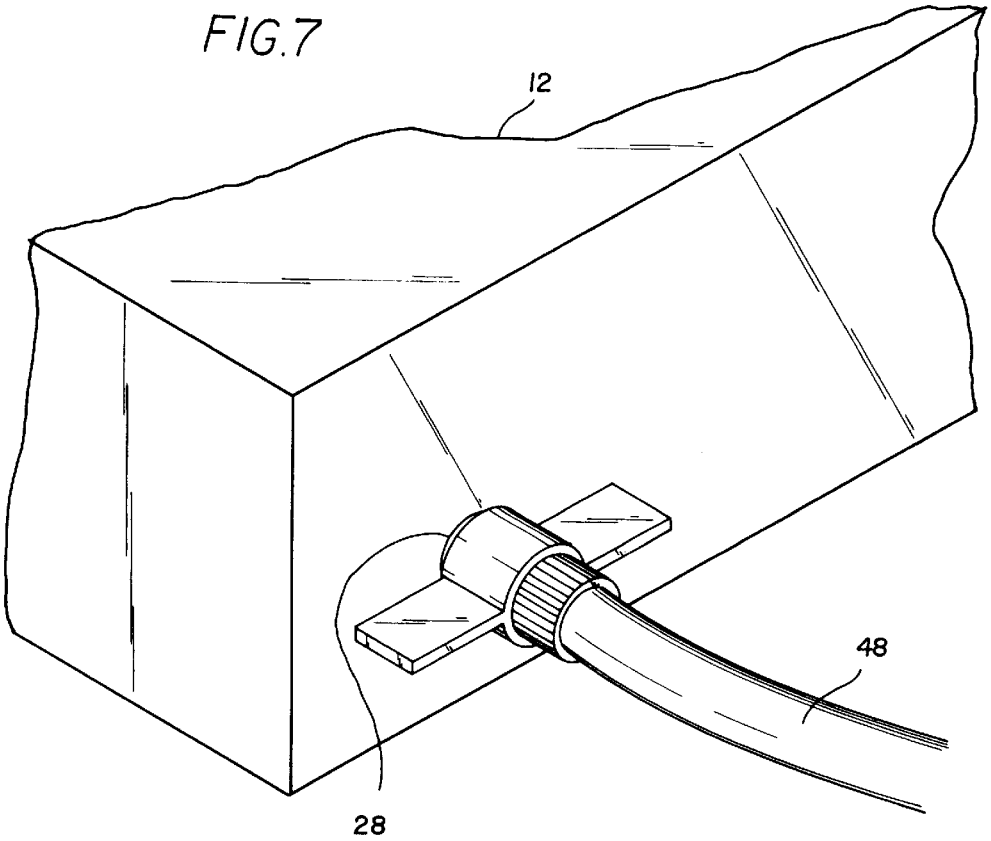
FIG. 7 is a perspective view of the hose of the present invention.
Figure 8:
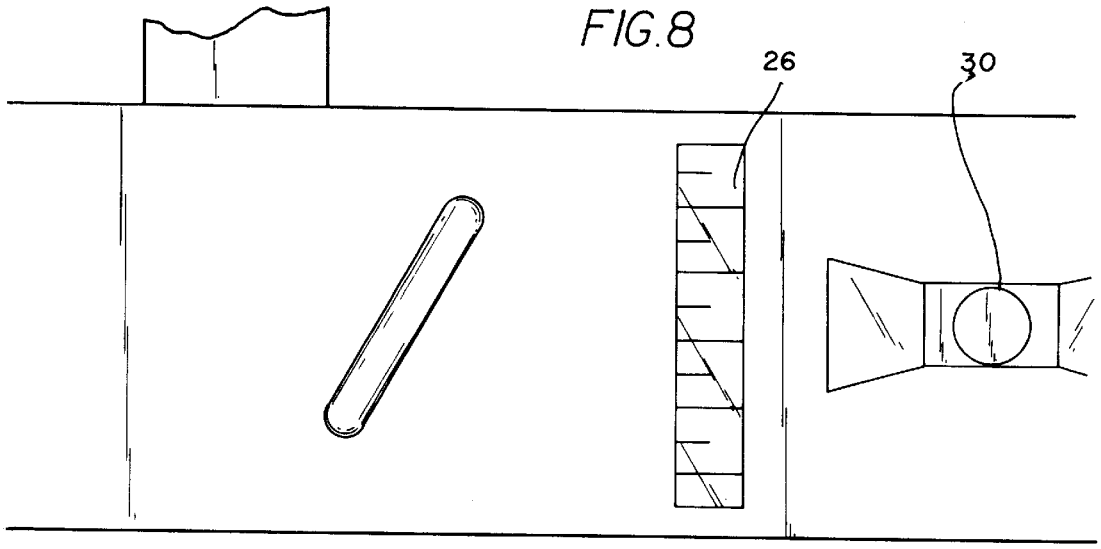
FIG. 8 is a side view of the viewing window of the present invention.

FIGS. 5 & 6 show a wheel assembly 38 including a pair of a legs 40 having inboard ends pivotally coupled to the side wall of the garbage can about a common axis. A pair of wheels are each rotatably coupled to an outboard end of an associated one of the legs. A pair of notches 42 are formed in the side wall of the garbage can between the legs and both above and below the axis. An arcuate connector bar 44 is integrally coupled between a central extent of the legs and further snappily coupleable with the notches. As such, the wheels may be pivoted coincidentally between a lowered deployed orientation and a raised stored orientation. To facilitate the transfer of the legs between the various orientations, a handle 46 is coupled to the outboard end of one of the legs in coaxial relationship with the associated wheel.

Finally, a flexible draining hose 48 includes a first end with a rotatable threaded sleeve. Such sleeve serves for screwably coupling with the neck of the outlet aperture. A pair of radially extending arms are coupled to the sleeve of the drainage hose for facilitating coupling and removal of the first end of the hose to the neck of the outlet aperture. While not shown, a second end of the hose preferably has a manually actuated valve for facilitating the watering of plants and the like with the water of the base.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A garbage can comprising, in combination:

a base having a hollow rectangular configuration with a top face, a bottom face and a thin periphery formed therebetween for defining an interior space, the top face having a cylindrical recess formed in a central extent thereof, an inlet aperture formed therein with a threaded neck coupled about the inlet aperture and extending upwardly therefrom for releasably coupling with a cap thereby allowing the selective filling of the interior space of the base with water, and a plurality of rectangular locking tabs each having a bottom edge hingably coupled about a periphery of the recess and having an interior surface with a lateral groove formed therein, a first one of four side faces of the thin periphery having a horizontally oriented closed loop handle mounted thereon, a second one of the four side faces opposite the first having ends each with a pair of vertically spaced disk-shaped bumpers extending therefrom, a third one of the side faces having a vertically oriented thin window formed therein for affording a view of a present level of water within the base, a fourth one of the side faces having an outlet aperture formed therein with a threaded neck coupled about the outlet aperture and extending outwardly therefrom for releasably coupling with a cap thereby allowing the selective emptying of the water within the interior space of the base, the bottom face having a matrix of vertically oriented pegs formed thereon and depending downwardly therefrom for inserting within earth;

a garbage can having a closed circular bottom face and an inverted frusto-conical side wall extending upwardly to terminate at an upper peripheral edge, a pair of closed loop handles integrally formed on diametrically opposed sides of the side wall, a lid defining a portion of a hollow sphere with a pair of handle defining grooves formed in an apex thereof and an annular flange depending therefrom for engaging with an interior surface of the upper peripheral edge of the side wall of the garbage can, and an annular protrusion formed on the side wall and extending radially therefrom adjacent to the bottom face thereof for coupling with the grooves of the locking tabs of the base upon the insertion of the garbage can within the cylindrical recess thereof;

a wheel assembly including a pair of a legs having inboard ends pivotally coupled to the side wall of the garbage can about a common axis, a pair of wheels each rotatably coupled to an outboard end of an associated one of the legs, a pair of notches formed in the side wall of the garbage can between the legs and both above and below the axis, and an arcuate connector bar integrally coupled between a central extent of the legs and further releasably coupleable with the notches such that the wheels may be pivoted coincidentally between a lowered deployed orientation and a raised stored orientation; and a flexible draining hose including a first end with a rotatable threaded sleeve for screwably coupling with the neck of the outlet aperture and a pair of radially extending arms extending from the sleeve of the drainage hose for facilitating coupling and removal of the first end of the hose to the neck of the outlet aperture.

2. A garbage can comprising:

a weighted base having a recess formed therein;

a garbage can having a bottom adapted to be releasably situated within the recess of the base; and locking means for coupling the can within the base, wherein the locking means includes an annular protrusion formed in the garbage can and locking tabs pivotally mounted on the base.

3. A garbage can as set forth in claim 2 and further including a hose for draining water from within the base.

4. A garbage can as set forth in claim 2 wherein the base has a handle mounted thereon.

5. A garbage can as set forth in claim 2 wherein the base is weighted with water.

6. A garbage can as set forth in claim 2 wherein the garbage can has wheels mounted on arms which are in turn pivotally coupled to the garbage can.

7. A garbage can as set forth in claim 2 wherein the base has a plurality of pegs depending therefrom.

* * * * *